US011920328B2

(12) United States Patent
Romero et al.

(10) Patent No.: US 11,920,328 B2
(45) Date of Patent: Mar. 5, 2024

(54) SPOUT WITH SLIDER DIVERTER

(71) Applicant: ASSA ABLOY Americas Residential Inc., New Haven, CT (US)

(72) Inventors: Oscar Romero, Lake Forest, CA (US); Haibo Cai, Xiamen (CN)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 287 days.

(21) Appl. No.: 17/354,506

(22) Filed: Jun. 22, 2021

(65) Prior Publication Data

US 2022/0010534 A1 Jan. 13, 2022

Related U.S. Application Data

(60) Provisional application No. 63/050,591, filed on Jul. 10, 2020.

(51) Int. Cl.
*E03C 1/02* (2006.01)
*E03C 1/04* (2006.01)

(52) U.S. Cl.
CPC ..... *E03C 1/023* (2013.01); *E03C 1/0404* (2013.01)

(58) Field of Classification Search
CPC ..... E03C 1/023; E03C 1/0404
See application file for complete search history.

(56) References Cited

U.S. PATENT DOCUMENTS 6,449,784 B1 9/2002 Pelletz
6,925,662 B1 8/2005 Tan et al.
8,176,580 B2 5/2012 Kajuch et al.
8,214,941 B2 7/2012 Furseth
9,790,667 B2 * 10/2017 Du ..... F16K 3/0254
2014/0109311 A1 * 4/2014 Bosio ..... E03C 1/0405 4/678
2018/0141068 A1 * 5/2018 Chiu ..... E03C 1/10
2020/0181892 A1 * 6/2020 Macsay ..... E03C 1/0405

FOREIGN PATENT DOCUMENTS

KR 10-2081751 B1 3/2020
WO 2011-135197 A1 11/2011

OTHER PUBLICATIONS

International Search Report and Written Opinion for PCT/US2021/038362, dated Oct. 22, 2021, 11 pages.
PCT International Preliminary Report on Patentability in International Application PCT/US2021/038362, dated Jan. 19, 2023, 8 pages.

* cited by examiner

*Primary Examiner* — Christine J Skubinna
(74) *Attorney, Agent, or Firm* — Merchant & Gould P.C.

(57) ABSTRACT

A diverter for a spout includes a housing defining a compartment with an opening and one or more passageways positioned around the compartment to allow passage of a water flow. An actuator extends into the compartment. The actuator is slidable in a first direction from a resting position to a diverting position and is slidable in a second direction from the diverting position to the resting position. The first and second directions are opposite directions parallel to a central axis of the housing. The actuator being configured to block the water flow when in the diverting position.

19 Claims, 12 Drawing Sheets

SPOUT WITH SLIDER DIVERTER

CROSS-REFERENCE TO RELATED APPLICATIONS

This application claims the benefit of U.S. Provisional Application Ser. No. 63/050,591, filed Jul. 10, 2020, the disclosure of which is hereby incorporated by reference in its entirety. To the extent appropriate, a claim for priority is made to the above application.

BACKGROUND

Tub spouts often include a diverter to divert the flow of water from the tub spout to a shower head in a shower. Generally, the diverter is positioned on the front of the tub spout and includes a handle that is pulled from a resting position to an upright position to divert the water. The handle remains in the upright position due to the pressure from the water flowing to the shower head. The handle returns to the resting position when the water flow is turned off such that water will flow through the tub spout during the next use of the shower.

Generally, the diverter is exposed to water such that calcium and other types of mineral deposits accumulate around the diverter. The accumulation of the mineral deposits can prevent the diverter from returning to the resting position after the water flow is turned off. Also, the handle of the diverter is often placed at a distal end of the tub spout where an outlet is located which limits the design flexibility of tub spouts. Therefore, improvements are desired.

SUMMARY

The present disclosure is generally directed to a diverter for a spout. In certain example embodiments, the diverter is slidable between a resting position and a diverting positon to divert water flow from the spout to another outlet.

One aspect of the present disclosure relates to a diverter for a spout. The diverter comprises: a housing defining a compartment with an opening, and one or more passageways positioned around the compartment to allow passage of a water flow; and an actuator extending into the opening of the compartment, the actuator being slidable in a first direction from a resting position to a diverting position and in a second direction from the diverting position to the resting position, the first and second directions being opposite directions parallel to a central axis of the spout, and the actuator blocks the water flow when in the diverting position.

The diverter further comprises a spring housed inside the compartment. The spring returns the actuator from the diverting position to the resting position when the water flow is turned off. The compartment shields the spring from exposure to the water flow.

The actuator includes a shaft that extends into the compartment, and a plunger connected to the shaft in a substantially orthogonal arrangement, the plunger being housed inside the compartment. The shaft is threadably connected to the plunger, and plunger moves with the shaft between the resting and diverting positions. The plunger includes a plug at a distal end that is configured to block the passage of the water flow from the one or more passageways.

The spring is positioned around the plunger and between the compartment and the shaft. The spring compresses from a relaxed state to a compressed state when the shaft is moved in the first direction from the resting position to the diverting position. The spring remains in the compressed state due to pressure from the water flow while the water flow is turned on. The spring expands from the compressed state to the relaxed state when the water flow is turned off, moving the plunger in the second direction from the diverting position to the resting position.

The diverter can further comprise a handle connected to the actuator and configured to be gripped by a user to move the actuator in the first direction from the resting position to the diverting position. The handle covers the opening of the compartment when the actuator is in both the resting and diverting positions. Also, the compartment has a drainage hole to drain water that enters through the opening of the compartment Another aspect of the present disclosure relates to a faucet assembly comprising: a spout configured to receive water flow, the spout including: a body that defines an interior cavity; a central axis that extends along a length of the body between a proximal end and a distal end of the body; a slot located between the proximal end and the distal end of the body; and an outlet located at the distal end of the body; and a diverter at least partially housed inside the interior cavity of the spout, the diverter including: a housing defining a compartment having an opening aligned with the slot on the body of the spout, and defining one or more passageways inside the interior cavity of the spout, the one or more passageways being positioned around the compartment to allow passage of the water flow to the outlet of the spout; an actuator that extends through the slot of the spout and into the compartment defined by the housing of the diverter, the actuator being slidable in a first direction parallel to the central axis from a resting position to a diverting position and being slidable in a second direction parallel to the central axis from the diverting position to the resting position, the first and second directions being opposite directions, and the actuator being configured to block the water flow to the outlet of the spout and divert the water flow away from the spout when in the diverting position; and a spring housed inside the compartment, the spring returns the actuator in the second direction from the diverting position to the resting position when the water flow is turned off, the compartment shields the spring from exposure to the water flow.

The actuator includes a shaft that extends through the slot of the spout and into the compartment in the housing of the diverter, and a plunger connected to the shaft in a substantially orthogonal arrangement. The plunger is housed inside the compartment in the housing of the diverter. The shaft is threadably connected to the plunger, and the plunger moves along with the shaft in the first and second directions between the rest and diverting positions. The plunger has a plug at a distal end configured to block the passage of the water flow from the one or more passageways defined by the housing of the diverter to the outlet of the spout.

The spring is positioned around the plunger and between the compartment and the shaft. The spring compresses from a relaxed state to a compressed state when the shaft is moved in the first direction from the resting position to the diverting position. The spring remains in the compressed state due to a pressure exerted on the plunger from the water flow while the water flow remains turned on. The spring expands from the compressed state to the relaxed state when the water flow is turned off such that the pressure is no longer exerted on the plunger. The expansion from the compressed state to the relaxed state causes the plunger to move in the second direction from the diverting position to the resting position.

A handle is connected to the actuator and configured to be gripped by a user to move the actuator in the first direction from the resting position to the diverting position. The handle covers both the slot on the body of the spout and the opening of the compartment in the diverter housing when the actuator is in both the resting and diverting positions. The compartment has a drainage hole to drain water that enters through the slot on the body of the spout.

The faucet assembly can further comprise a flow conversion component on the body of the spot to provide a cascade flow for the water flow after exiting from the outlet of the spout. The faucet assembly can also further comprise a sprayer or shower head, and wherein the diverter diverts the water flow from the spout to the sprayer or shower head when the actuator is in the diverting position.

Another aspect relates to a faucet assembly comprising: a spout configured to receive a water flow, the spout including: a body that defines an interior cavity; a central axis that extends along a length of the body between a proximal end and a distal end of the body; a slot located between the proximal end and the distal end of the body; and an outlet located at the distal end of the body; and a diverter at least partially housed inside the interior cavity of the spout, the diverter including: a housing defining a compartment having an opening aligned with the slot on the body of the spout, and defining one or more passageways inside the interior cavity of the spout, the one or more passageways being positioned around the compartment to allow passage of the water flow to the outlet of the spout; an actuator that includes a shaft that extends through the slot of the spout and into the compartment defined by the housing of the diverter, and a plunger connected to the shaft, the plunger being configured to slide in a first direction parallel to the central axis from a resting position to a diverting position, and configured to slide in a second direction parallel to the central axis from the diverting position to the resting position, the first and second directions being opposite directions, and the plunger being configured to divert the water flow away from the spout when in the diverting position; and a spring housed inside the compartment, wherein the spring is configured to move the plunger in the second direction from the diverting position to the resting position when the water flow is turned off.

Another aspect relates to a diverter for a spout, the diverter comprising: a housing defining a compartment with an opening and one or more passageways positioned around the compartment to allow passage of a water flow; and an actuator extending into the opening of the compartment, the actuator being slidable in a first direction from a resting position to a diverting position and in a second direction from the diverting position to the resting position, the first and second directions being opposite directions that are parallel to a central axis of the spout, and the actuator being configured to block the water flow when in the diverting position.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
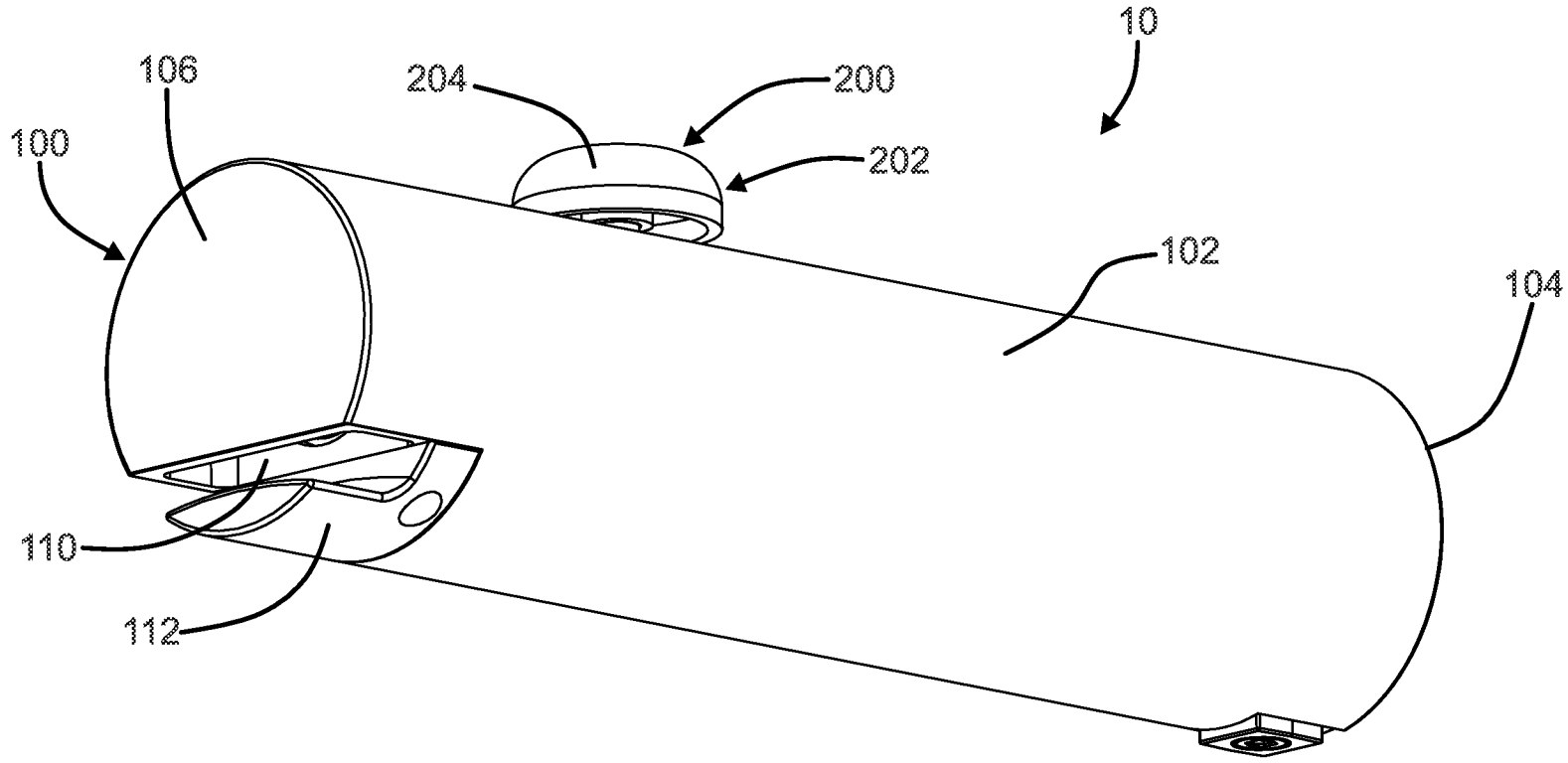
FIG. 1 is a perspective view of a faucet assembly according to an example embodiment of the present disclosure.
Figure 2:
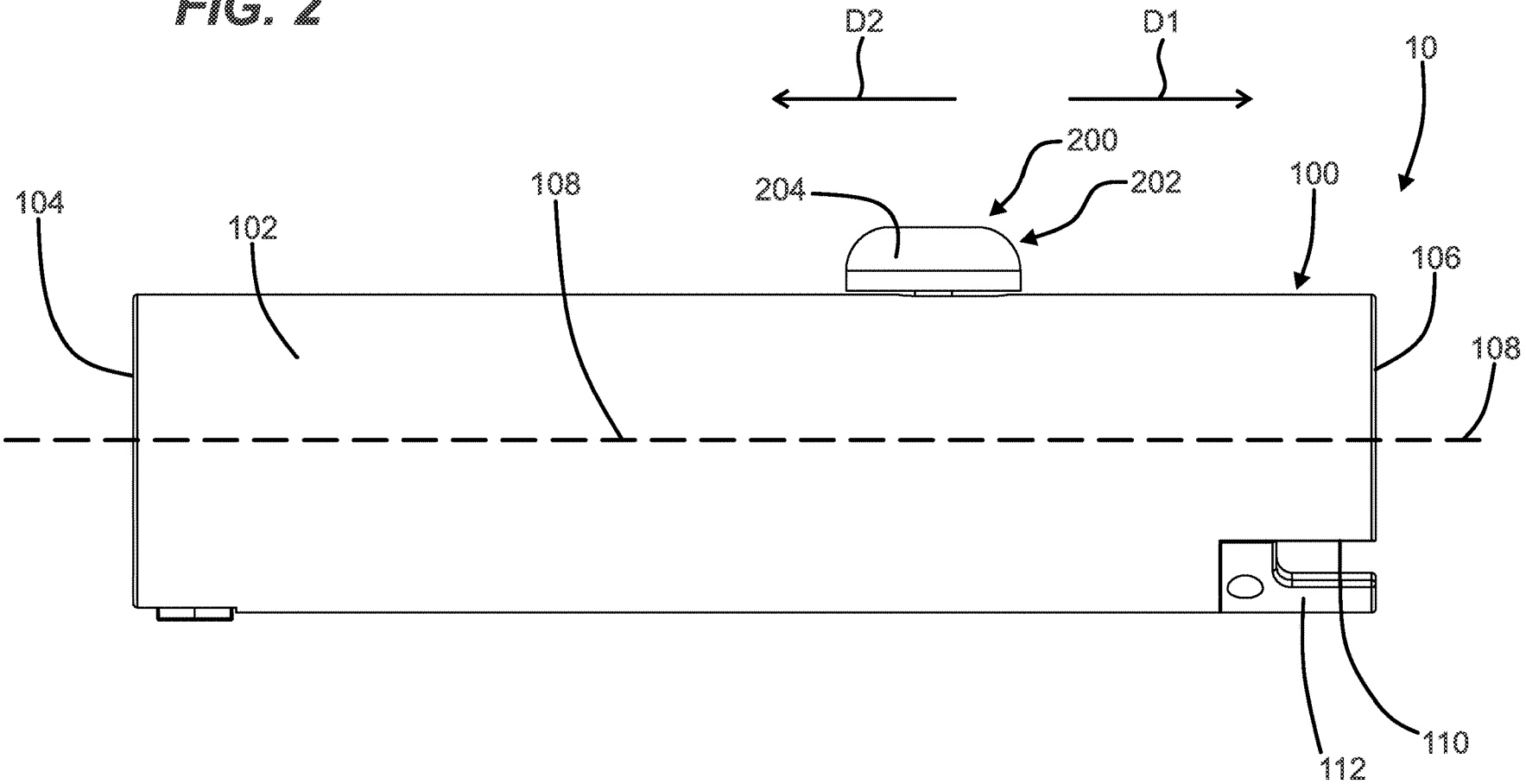
FIG. 2 is a left side view of the faucet assembly of FIG. 1.
Figure 3:
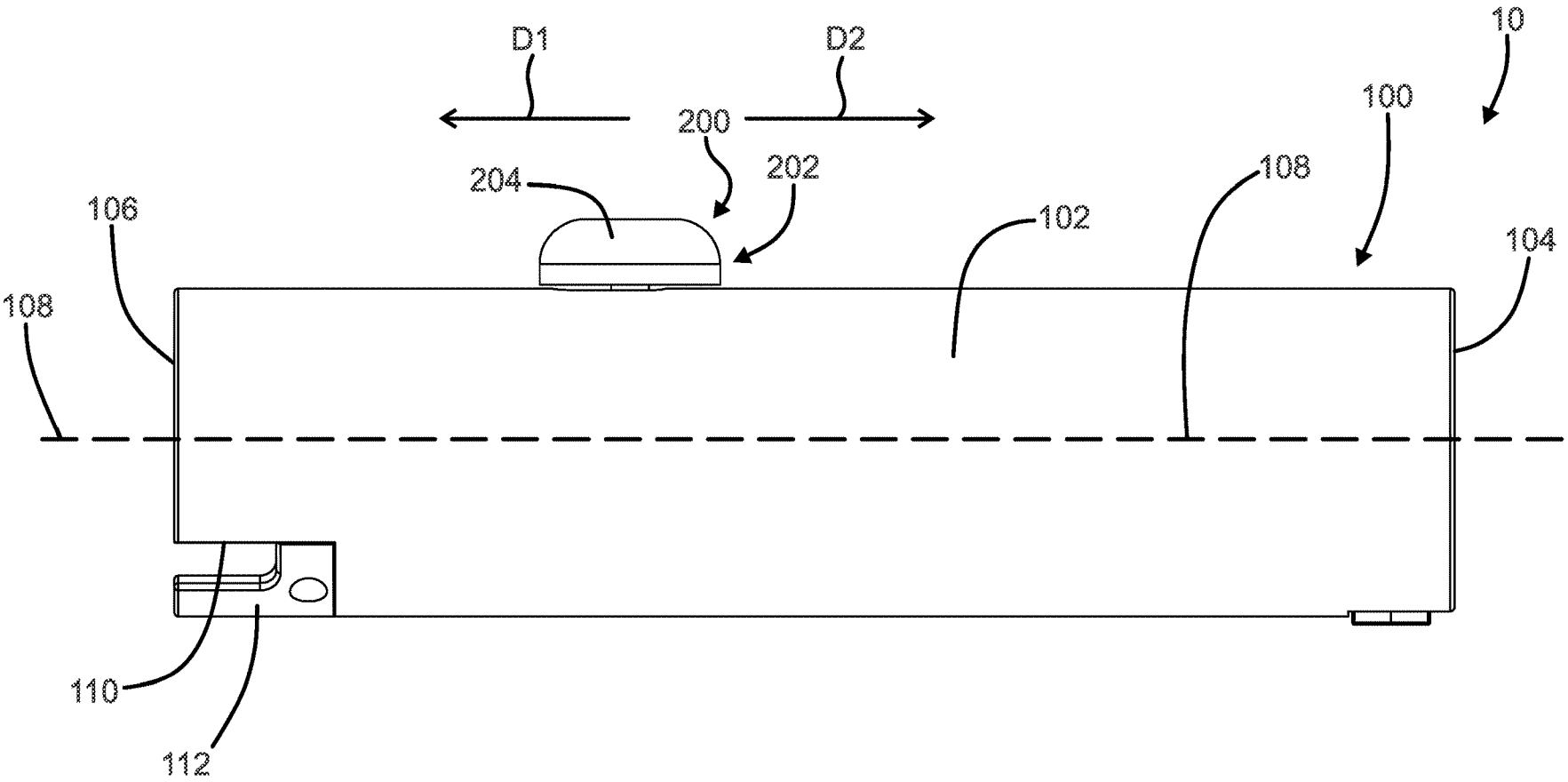
FIG. 3 is a right side view of the faucet assembly of FIG. 1.
Figure 4:
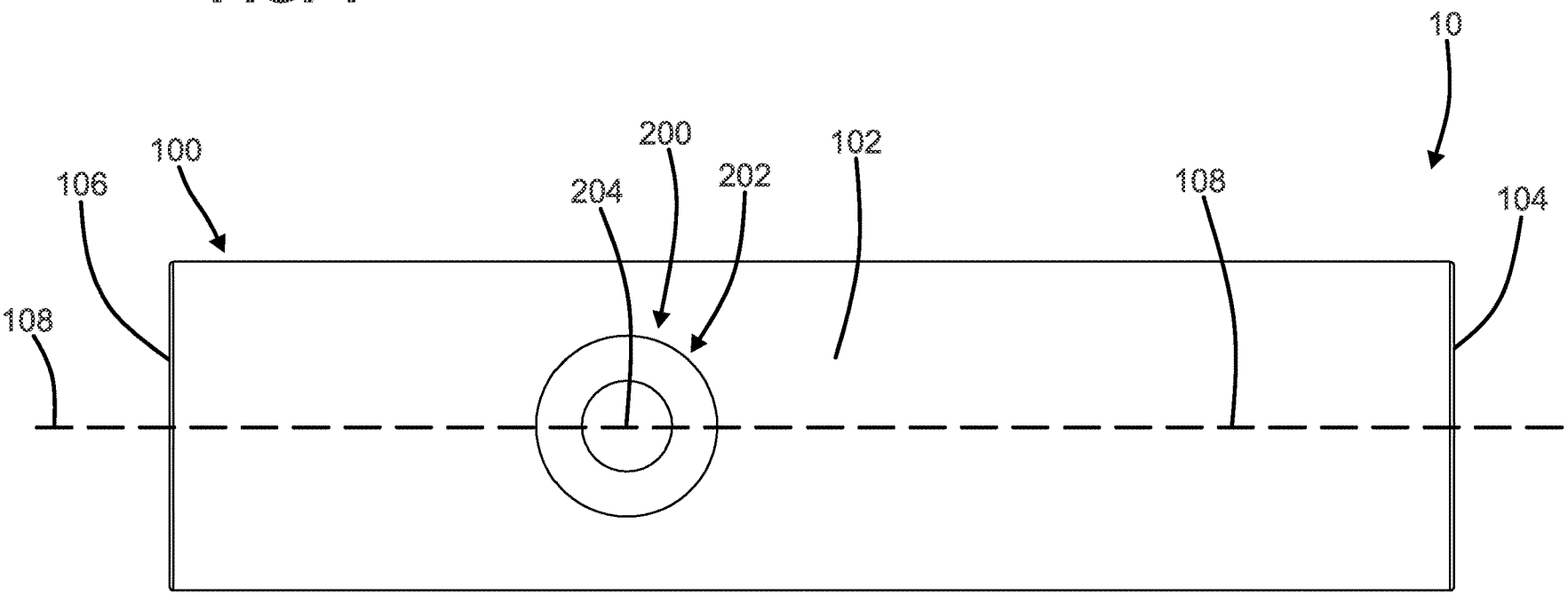
FIG. 4 is a top view of the faucet assembly of FIG. 1.
Figure 5:
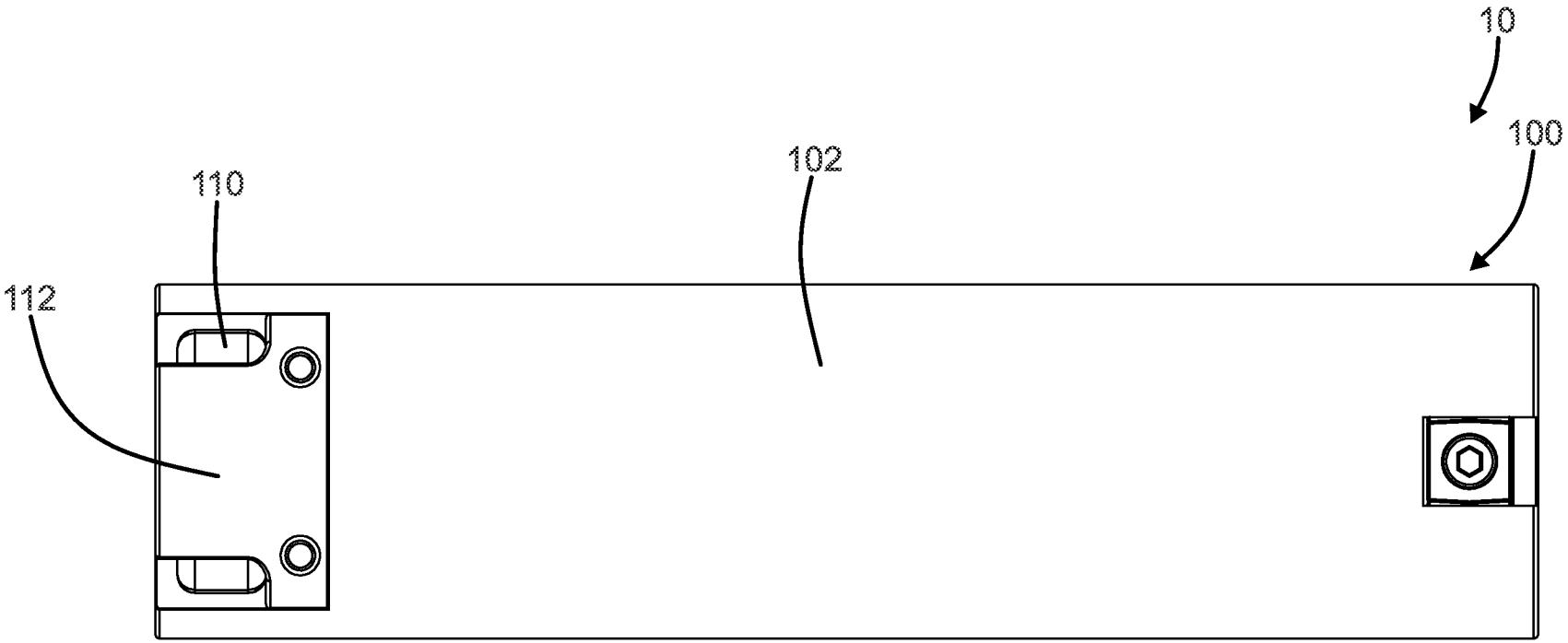
FIG. 5 is a bottom view of the faucet assembly of FIG. 1.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

This disclosure generally relates to a diverter that slides from a resting position to a diverting position to divert water flow from a spout to another outlet. Advantageously, the sliding diverter is easy to operate especially for individuals who have arthritis of the wrist. Additionally, the diverter takes up less space and can be positioned away from the distal end of the spout, such as on a location positioned between the distal end and a proximal end of the spout, such that the diverter provides greater design flexibility for designing the spout.

Additionally, when the water flow is turned off, the diverter automatically returns from the diverting position to the resting position by a mechanism that is sealed from the water flow. Advantageously, this can prevent the buildup of mineral deposits around the mechanism that could prevent the diverter from automatically returning to the resting position.

FIG. 1 is a perspective view of a faucet assembly 10 according to an example embodiment of the present disclosure. The faucet assembly 10 includes a diverter 200 at least partially housed inside a spout 100. In some embodiments, the spout 100 is a tub spout used for filling a bath tub with water, and the diverter 200 is structured to divert water flow from the tub spout to another outlet such as a shower head. While the spout 100 is described in certain examples as directed for use in a bath tub, the diverter 200 can be adapted for use in other additional environments such as a kitchen sink faucet in which the diverter 200 diverts the water flow from the kitchen sink faucet to another outlet such as a sprayer. Additional environments and uses for the diverter 200 are contemplated and as such, the aforementioned examples are illustrative and are not meant to limit the applicability of the diverter 200 in any way.

FIGS. 2-6 are left side, right side, top, bottom, and front views, respectively, of the faucet assembly 10. Referring now to FIGS. 1-6, the spout 100 includes a body 102 that defines an interior cavity. The body 102 has a proximal end 104, a distal end 106, and a central axis 108 that extends along a length of the spout 100 between the proximal end 104 and distal end 106. The spout 100 includes an outlet 110 located at the distal end 106 of the body 102. The spout 100 is configured to receive water from a water supply such that the water exits the outlet 110.

In the example embodiment illustrated in the figures, the spout 100 includes a flow conversion component 112 connected to the body 102 to provide a cascade flow for the water after exiting from the outlet 110 of the spout 100. In some embodiments, the spout 100 does not include the flow conversion component 112 such that this component is optional.

The diverter 200 includes an actuator 202 that extends into the body 102 of the spout 100. The actuator 202 is slidable along the central axis 108 of the spout 100 between a resting position 210 (see FIG. 8) and a diverting position 212 (see FIG. 9). As will be described in more detail, when in the resting position 210, the diverter 200 allows water to flow through the outlet 110 of the spout 100 when the water supply to the spout 100 is turned on. When in the diverting position 212, the diverter 200 diverts the water flow away from the outlet 110 of the spout 100 to another outlet such as a shower head or sprayer while the water supply remains turned on.

The actuator 202 includes a handle 204 that can be gripped by a user to slide the actuator 202 in a first direction D1 from the resting position 210 to the diverting position 212. In the embodiment depicted in the figures, the first direction D1 is a forward direction defined as a direction from the proximal end 104 of the spout 100 to the distal end 106 of the spout 100. In alternative embodiments, the first direction D1 is a rearward direction defined as a direction from the distal end 106 of the spout 100 to the proximal end 104 of the spout 100.

When the water supply is turned off, the actuator 202 automatically returns from the diverting position 212 to the resting position 210 by sliding in a second direction D2. In the embodiment depicted in the figures, the second direction D2 is a rearward direction defined as a direction from the distal end 106 of the spout 100 to the proximal end 104 of the spout 100. In alternative embodiments, the second direction D2 is a forward direction defined as a direction from the proximal end 104 of the spout 100 to the distal end 106 of the spout 100.

Figure 7:
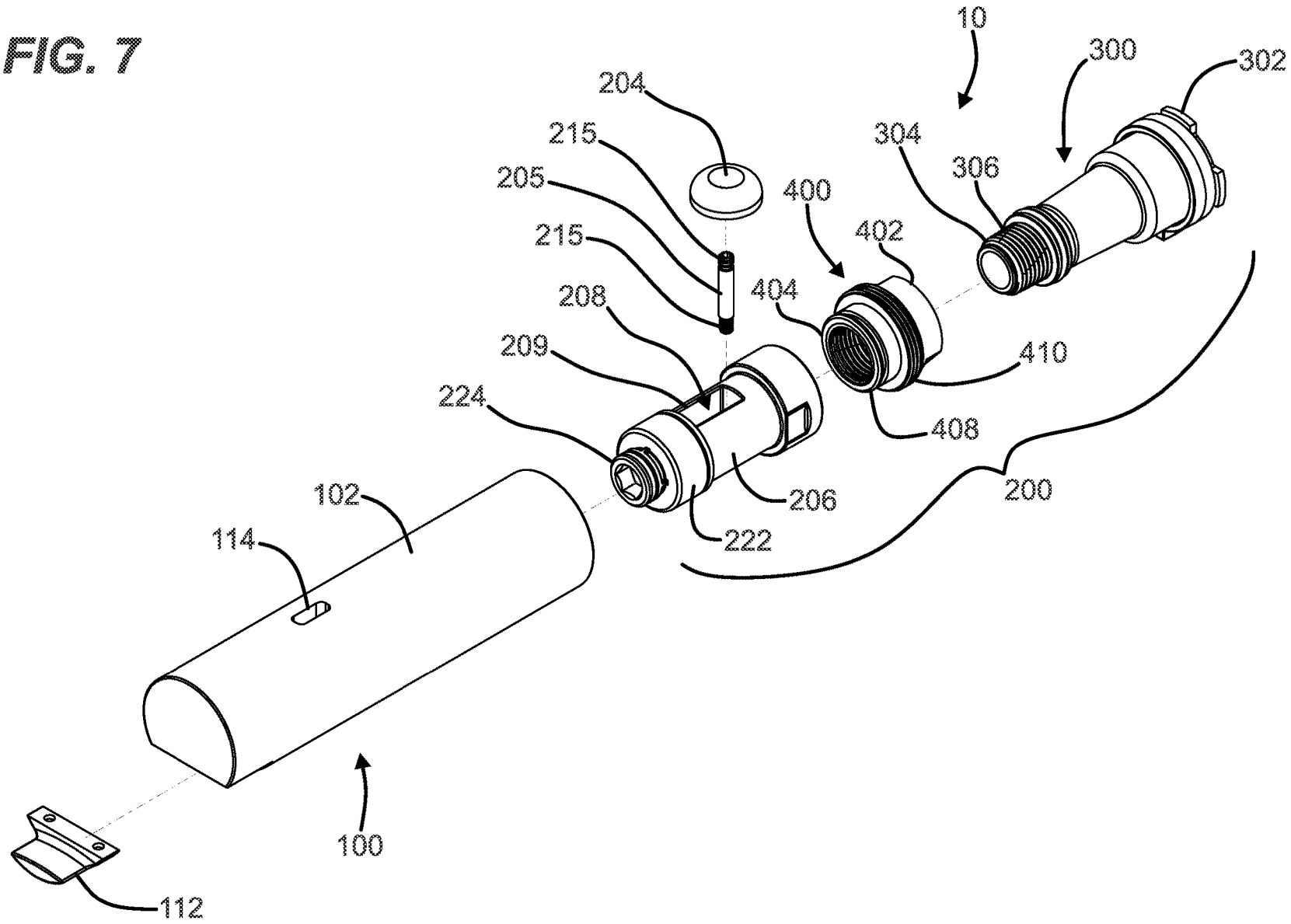
FIG. 7 is an exploded perspective view of the faucet assembly of FIG. 1.

FIG. 7 is an exploded perspective view of the faucet assembly 10. Referring now to FIG. 7, the body 102 of the spout 100 includes a slot 114 located between the proximal end 104 and distal end 106. The diverter 200 includes a housing 206 that is insertable into the interior cavity of the body 102. The housing 206 defines a compartment 208 having an opening 209. When the housing 206 is inserted into the interior cavity of the body 102, the opening 209 of the compartment 208 is aligned with the slot 114 on the body 102. The actuator 202 includes a shaft 205 that extends through the slot 114 and into the compartment 208 of the housing 206.

The faucet assembly 10 includes an adapter 300 that is configurable to adapt the faucet assembly 10 for connection with a water supply such as a copper pipe. As an illustrative example, the adapter 300 is configurable to connect the faucet assembly 10 with a plurality of copper pipes having differently sized diameters. The adapter 300 has a proximal end 302 and a distal end 304. The proximal end 302 is configured to attach to the water supply, and to provide a smooth and leak-free transfer of water from the water supply to the faucet assembly 10.

The faucet assembly 10 further includes a coupling 400 that at a first end 402 connects to the distal end 304 of the adapter 300, and that at a second end 404 connects to the diverter 200 to provide a smooth and leak-proof transfer of the water flow from the adapter 300 to the diverter 200. While the embodiment depicted in the figures illustrates the adapter 300 and the coupling 400 as separate components that attach together, in alternative embodiments, the adapter 300 and the coupling 400 can be integrated together into a single component.

The coupling 400 includes threads 406 (see also FIGS. 8 and 9) that are threadable onto corresponding threads 306 of the adapter 300 to provide a water-tight connection between the coupling 400 and the adapter 300. While the embodiment illustrated in the figures shows the threads 406 as internal threads and the threads 306 as external threads, alternative arrangements are possible where the threads 406 are external threads and the threads 306 are internal threads.

The coupling 400 further includes threads 408 that are threadable onto corresponding threads 214 of the diverter 200 (see FIGS. 8 and 9) to provide a water-tight connection between the coupling 400 and the diverter 200. Thus, the coupling 400 in combination with the adapter 300 is able to provide a water-tight and leak-proof connection between the diverter 200 and the water supply. While the example embodiment illustrated in the figures shows the threads 408 as external threads and the threads 214 as internal threads, alternative arrangements are possible. For example, the threads 408 can be internal threads and the threads 214 can be external threads.

The coupling further includes external threads 410 that threadably engage internal threads 116 of the body 102 of the spout (see also FIGS. 8 and 9) to secure the coupling 400 as well as the housing 206 and the adapter 300 inside the interior cavity of the spout 100.

The diverter 200 can further include a front piece 222 that attaches to the housing 206. The front piece 222 defines an outlet 224 for water from the water supply to exit the housing 206 and flow toward the outlet 110 of the spout 100. The front piece 222 includes threads 226 (see FIGS. 8 and 9) that are threadable onto corresponding threads 228 of the diverter 200 (see FIGS. 10 and 11) to provide a water-tight connection between the front piece 222 and the housing 206. While the embodiment depicted in the figures illustrates the front piece 222 and the housing 206 as separate components that attach together, in alternative embodiments the front piece 222 and housing 206 can be integrated together into a single component.

Figure 6:
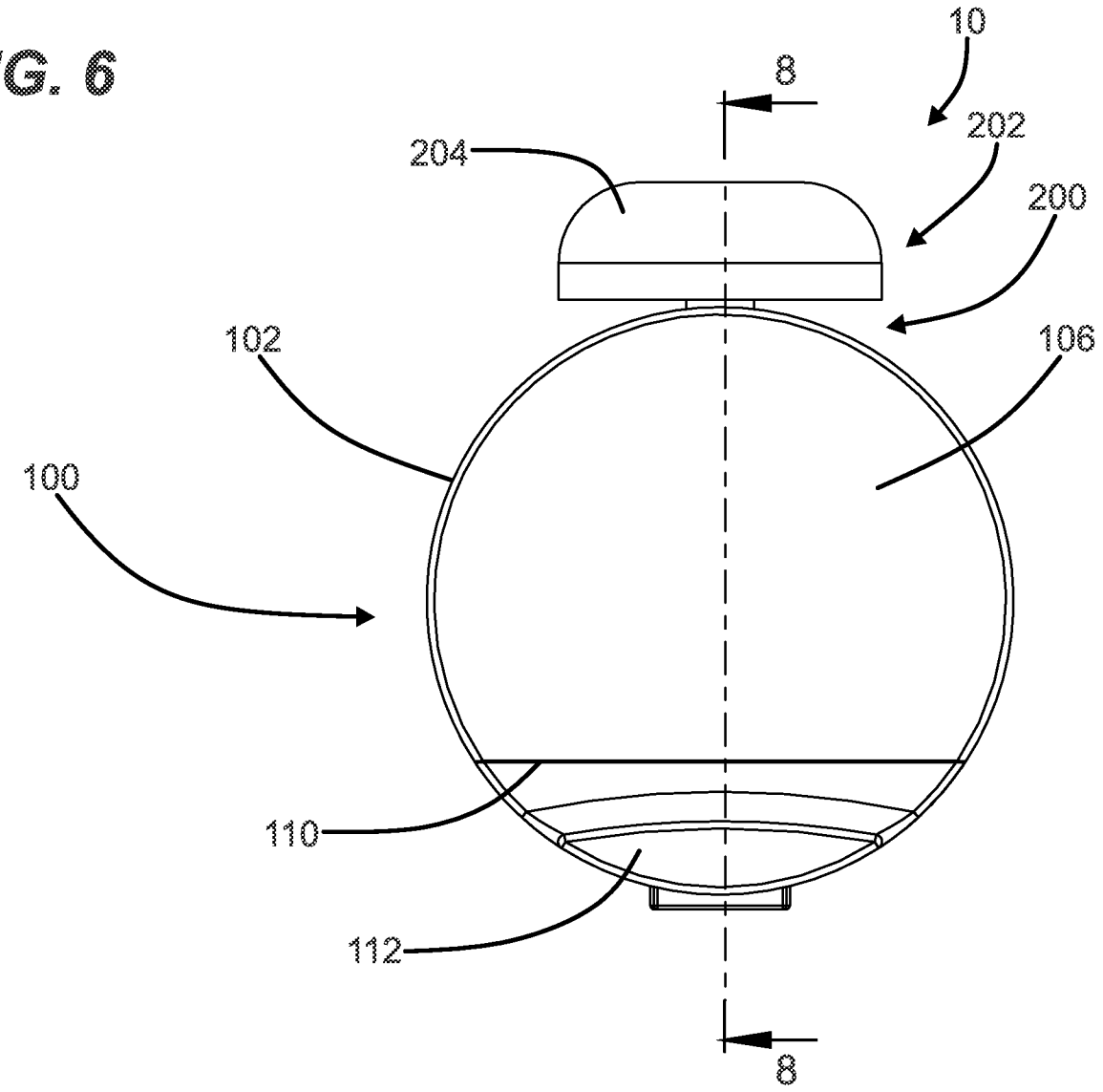
FIG. 6 is a front view of the faucet assembly of FIG. 1.
Figure 8:
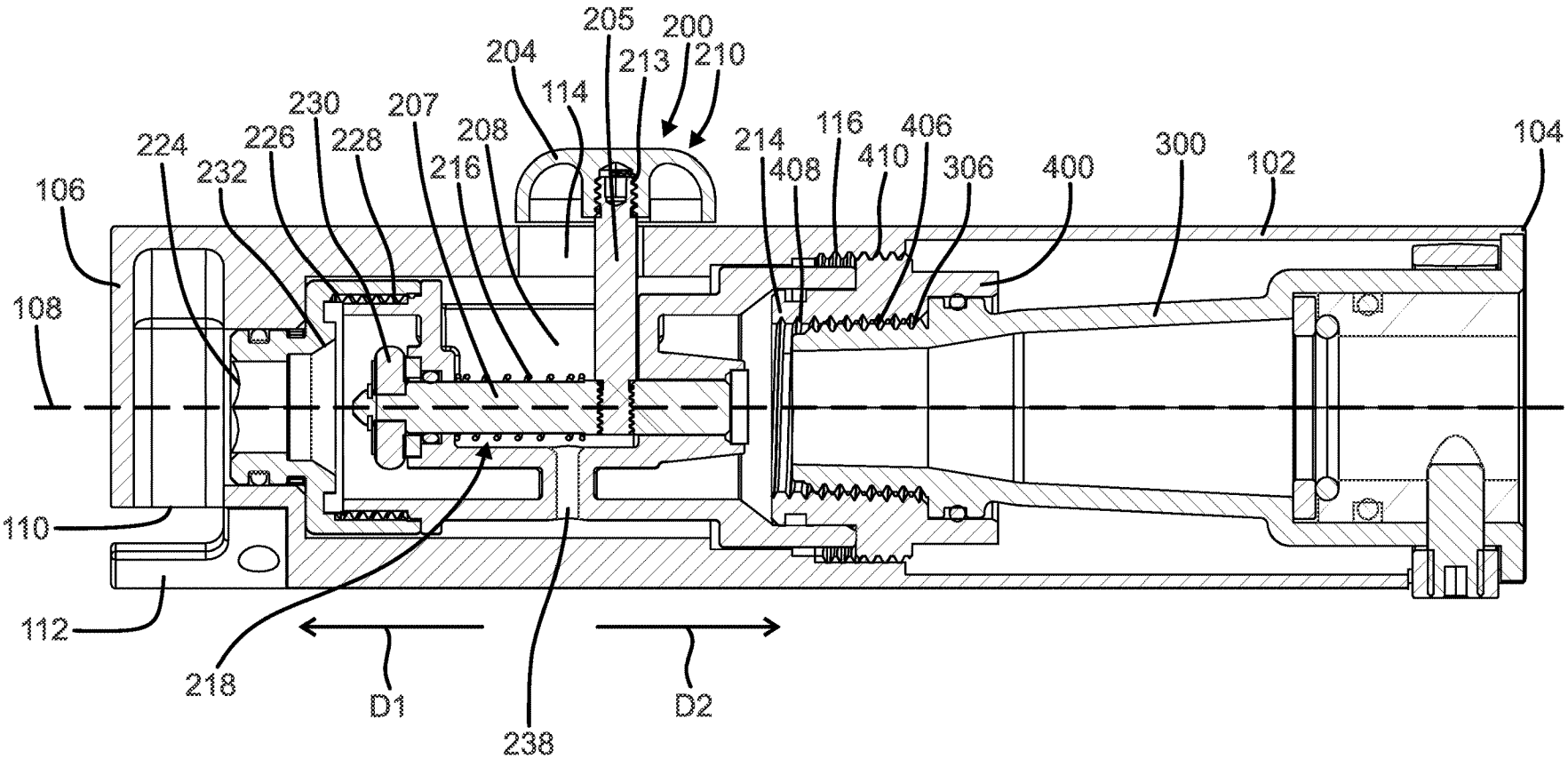
FIG. 8 is a cross-sectional side view of the faucet assembly of FIG. 1, a diverter at least partially housed inside a spout is shown in a resting position.
Figure 9:
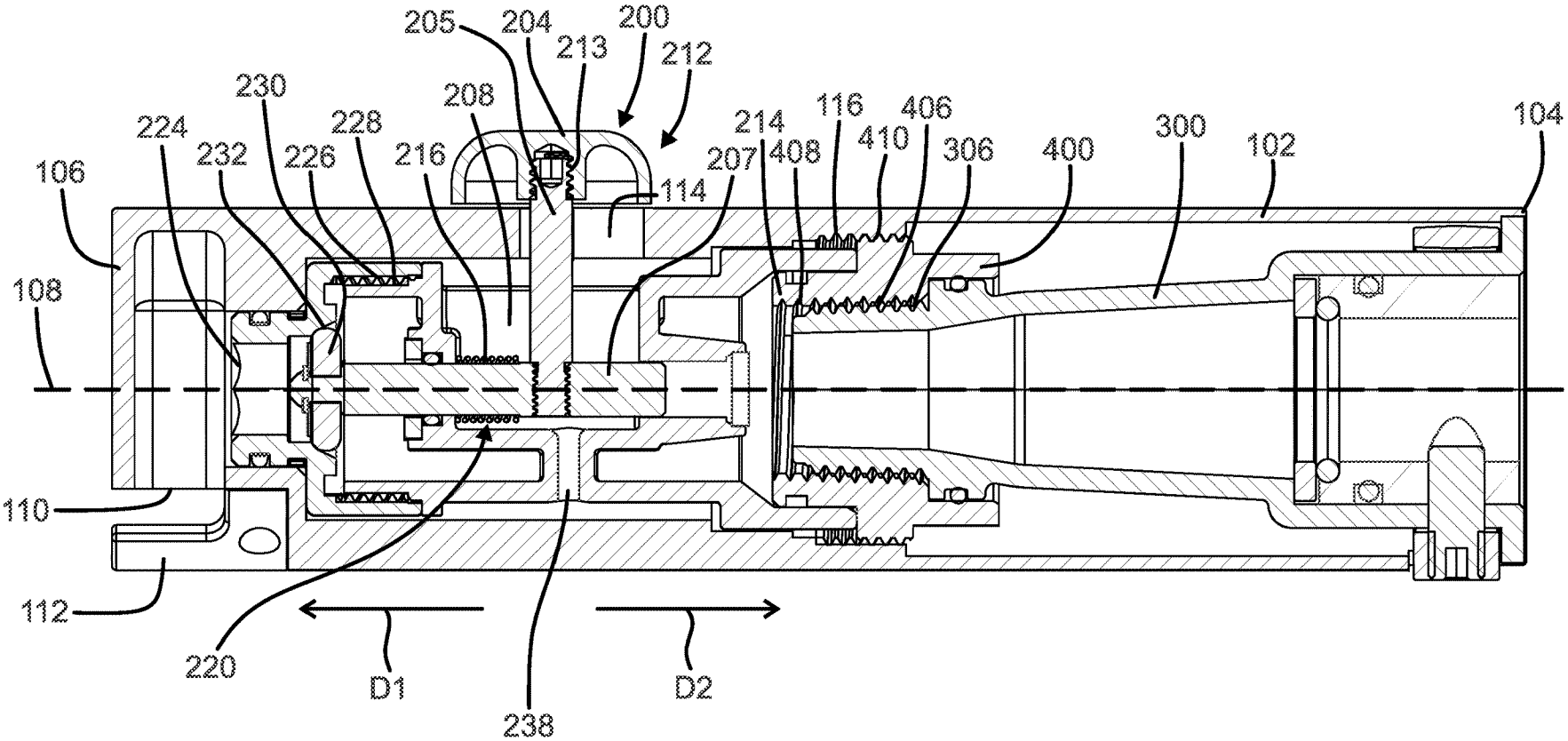
FIG. 9 is a cross-sectional side view of the faucet assembly of FIG. 1, the diverter at least partially housed inside the spout is shown in a diverting position.

FIGS. 8 and 9 are cross-sectional side views of the faucet assembly 10 taken along the plane 8-8 shown in the front view of FIG. 6. In FIG. 8, the diverter 200 is shown in the resting position 210, while in FIG. 9, the diverter 200 is shown in a diverting position 212.

Referring now to FIGS. 7-9, the diverter 200 includes the handle 204 connected to the shaft 205, and the shaft 205 extends into the compartment 208 of the housing 206 of the diverter 200. In the embodiment depicted in the figures, the handle 204 includes threads 213 that threadably engage external threads 215 on the shaft 205 to connect the handle 204 and shaft 205 together. In alternative embodiments, the handle 204 and shaft 205 are integral pieces such that the handle 204 and shaft 205 are not separate pieces that attach together.

The actuator 202 further includes a plunger 207 connected to the shaft 205 in a substantially orthogonal arrangement. The plunger 207 is housed inside the compartment 208. In one example embodiment, the shaft 205 includes external threads 215 (see FIG. 7) that threadably engage corresponding internal threads 211 of the plunger 207 (see FIG. 10) to connect the shaft 205 and plunger 207 together such that the plunger 207 moves along with the shaft 205 and the handle 204 between the resting and diverting positions 210, 212. Other arrangements for connecting together the shaft 205 and the plunger 207 are possible.

A plug 230 is attached to a distal end of the plunger 207. As shown in FIG. 9, when the actuator 202 is in the diverting position 212, the plug 230 seals an internal opening 232 of the front piece 222 to block water from flowing through the outlet 224 of the front piece and to the outlet 110 of the spout 100. Instead, the blockage from the plug 230 causes the water flow to be diverted away from the spout 100 and toward another outlet such as a sprayer or shower head. Additionally, the pressure from the water flow acts on the plug 230 such that the actuator 202 remains in the diverting position 212 while the water flow is diverted away from the spout 100.

A spring 216 is housed inside the compartment 208 of the diverter. The spring 216 is configured to return the actuator 202 from the diverting position 212 to the resting position 210 when the water flow from the water supply is turned off, such that the water pressure no longer acts on the plug 230 to maintain the actuator 202 in the diverting position 212. The spring 216 is positioned around the plunger 207 and between the compartment 208 and the shaft 205. The spring 216 compresses from a relaxed state 218 to a compressed state 220 when the shaft 205 is moved in the first direction D1 from the resting position 210 to the diverting position 212.

The spring 216 remains in the compressed state 220 while the water flow from the water supply remains turned on due to the water pressure acting on the plug 230. For example, the spring 216 can be configured to have a spring force that is less than or equal to the pressure from the water flow exerted on the plug 230, such that the spring 216 remains in the compressed state 220 while the water flow remains turned on. In certain embodiments, a water pressure of 10 psi or more maintains the plug 230 and spring 216 in the compressed state such that actuator 202 remains in the diverting position 212 while the water flow remains turned on.

When the water flow from the water supply is turned off, the spring 216 expands from the compressed state 220 to the relaxed state 218 because the pressure from the water flow is no longer exerted on the plug 230, such that the spring force of the spring 216 causes the spring 216 to expand. When the spring 216 expands from the compressed state 220 to the relaxed state 218, the spring force of the spring 216 pushes the shaft 205 and plunger 207 in the second direction D2 from the diverting position 212 to the resting position 210. When the water flow is turned off, the spring 216 automatically returns the actuator 202 to the resting position 210.

When the water supply is turned back on during a subsequent use of the faucet assembly 10, the actuator 202 will be in the resting position 210 and water will flow out of the outlet 110. In order to divert the water from the outlet 110 to another outlet such as a sprayer or shower head, the user would need to slide the handle 204 back to the diverting position 212.

Advantageously, the compartment 208 shields the spring 216 from the water flow that flows through the diverter 200 such that the buildup of mineral deposits around the spring 216 after prolonged use of the faucet assembly 10 is significantly reduced. Accordingly, the durability and reliability of the faucet assembly 10 is improved.

Still referring to FIGS. 8 and 9, the handle 204 is shaped and sized to shield both the slot 114 of the spout 100 and the compartment 208 when the actuator 202 is in both the resting and diverting positions 210, 212. Advantageously, this can help keep the water diverted to the sprayer or shower head from entering the compartment 208 where the spring 216 is housed, such that the water does not deteriorate the spring 216 after prolonged use of the faucet assembly 10. Thus, the shape of the handle 204 can further enhance the durability of the faucet assembly 10.

Additionally, the housing 206 includes a drainage hole 238 to drain any water that enters into the compartment 208. Advantageously, this helps to ensure that the water does not remain inside the compartment 208 such that the water does not deteriorate the spring 216. Thus, the drainage hole 238 can further enhance the durability of the faucet assembly 10.

Figure 10:
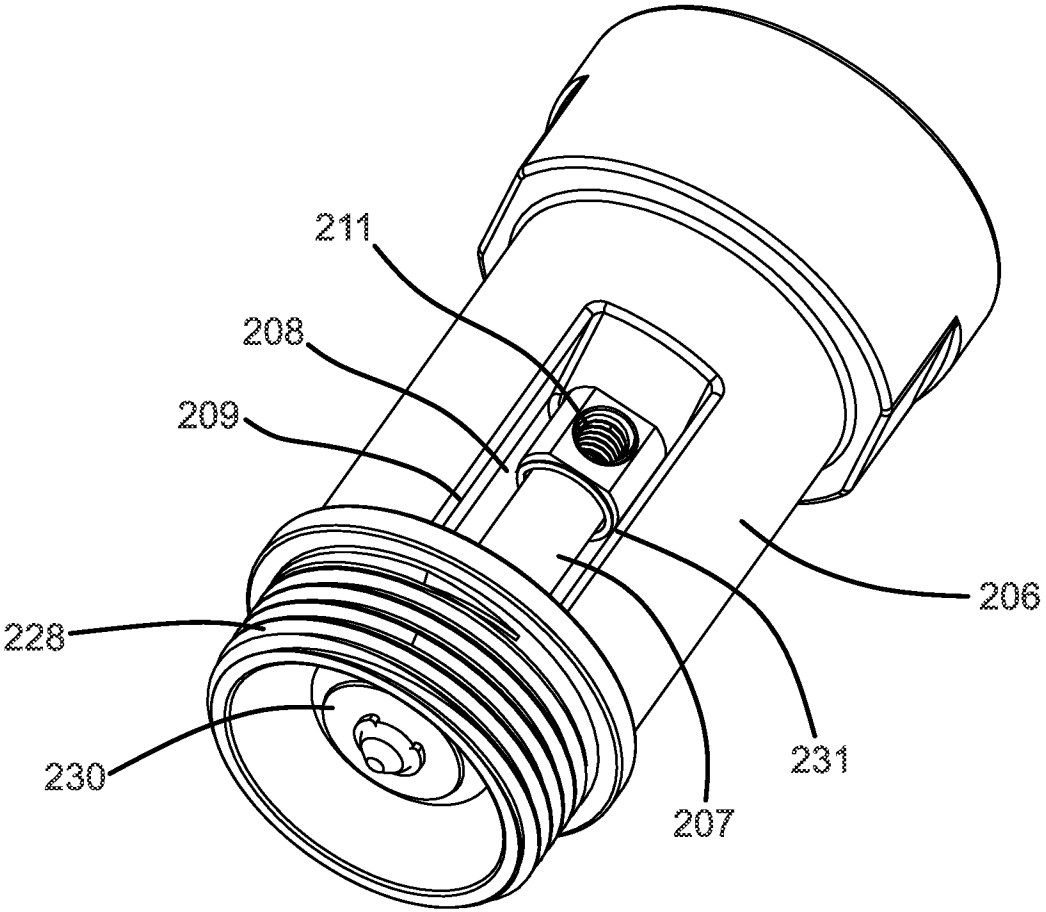
FIG. 10 is a perspective view of the diverter removed from the spout.

FIG. 10 is a perspective view of the diverter 200. As shown in FIG. 10, the plunger 207 is housed inside the compartment 208 of the housing 206. In the embodiment illustrated in the figure, the plunger 207 has internal threads 211 for threadably connecting the shaft 205 to the plunger 207. Alternative arrangements are possible for connecting the plunger 207 with the shaft 205. Also, in alternative embodiments, the plunger 207 and shaft 205 can be integral pieces such that the plunger 207 and shaft 205 are not separate pieces that attach together.

The plunger 207 can include a planar surface 231 that projects radially from the body of the plunger 207. In this embodiment, the spring 216 engages the planar surface 231 such that the spring 216 compresses and expands between the planar surface 231 and a sidewall of the compartment 208 between the resting and diverting positions 210, 212.

In an alternative embodiment, the plunger 207 does not include a planar surface 231 such that the spring 216 instead engages the shaft 205, which is substantially orthogonal to the plunger 207. In this embodiment, the spring 216 compresses and expands between the shaft 205 and a sidewall of the compartment 208 between the resting and diverting positions 210, 212.

As shown in FIG. 10, the plug 230 is attached to a distal end of the plunger 207. The plug 230 is a rubber washer or grommet. As described above, the plug 230 blocks the flow of water to the outlet 110 of the spout 100 when the actuator 202 is in the diverting position 212.

Figure 11:
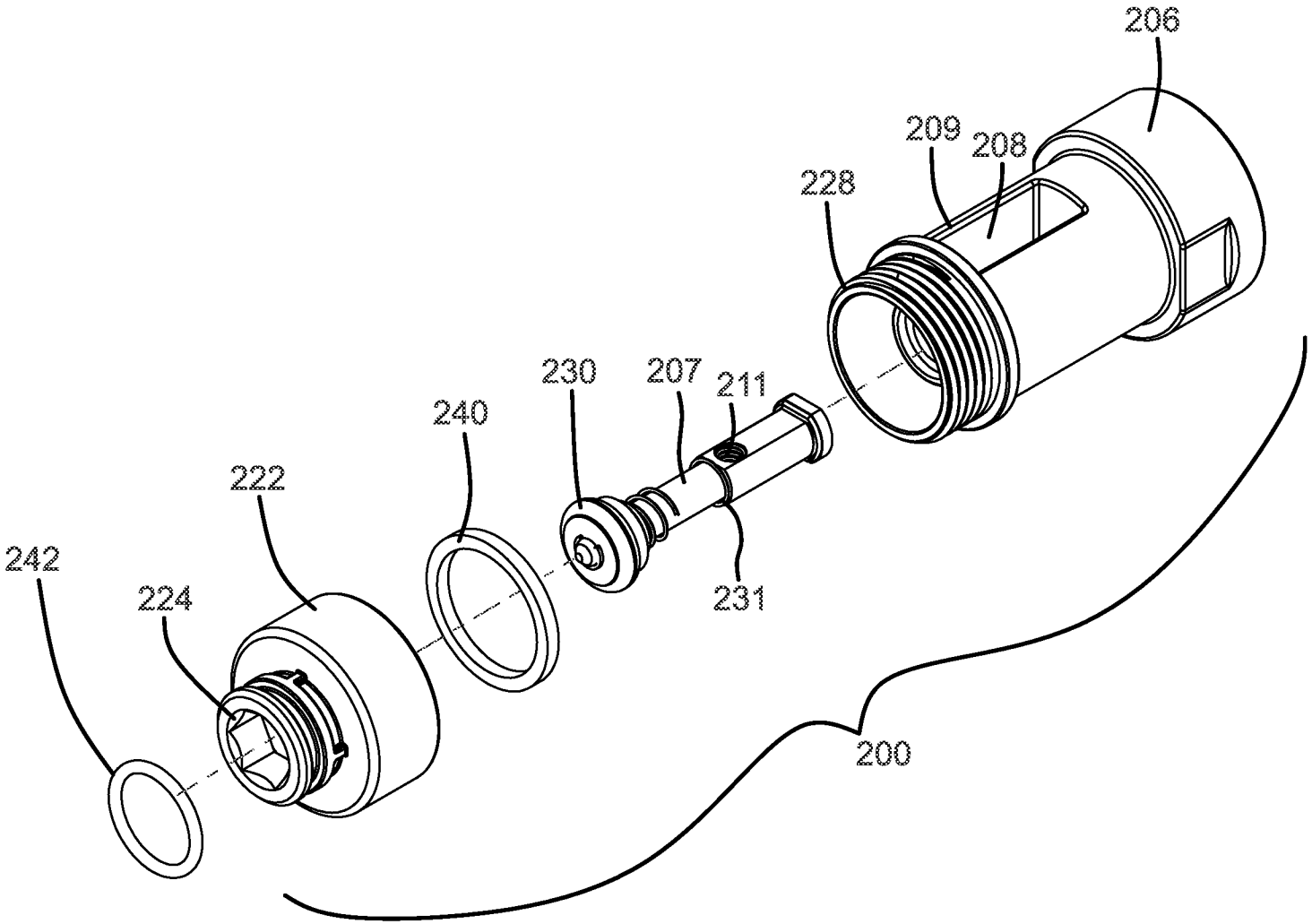
FIG. 11 is an exploded perspective view of the diverter of FIG. 10.

FIG. 11 is an exploded perspective view of the diverter 200. As shown in FIG. 11, the diverter 200 can include a gasket 240 to provide a water-tight seal between the housing 206 and the front piece 222. Additionally, the diverter 200 can include a gasket 242 to provide a water-tight seal between the front piece 222 and the body 102 of the spout 100.

Figure 13:
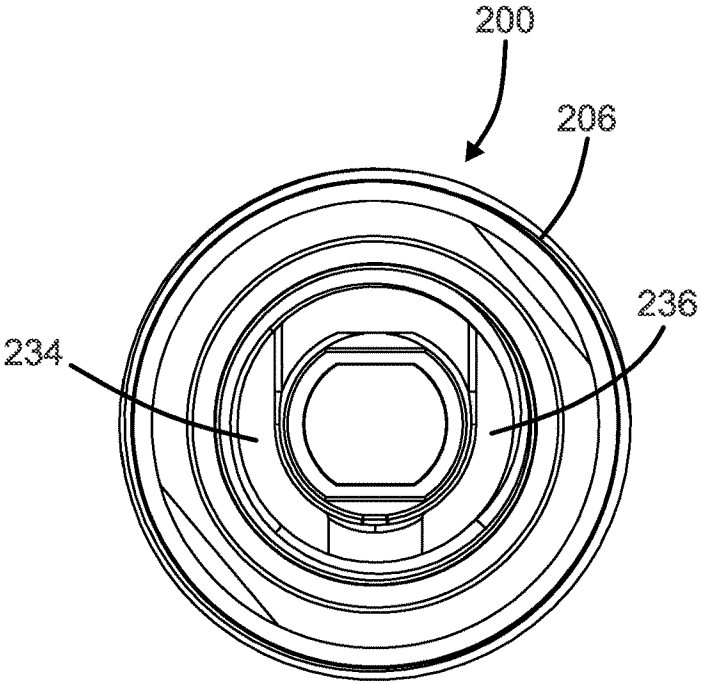
FIG. 13 is a rear view of the diverter of FIG. 10.
Figure 12:
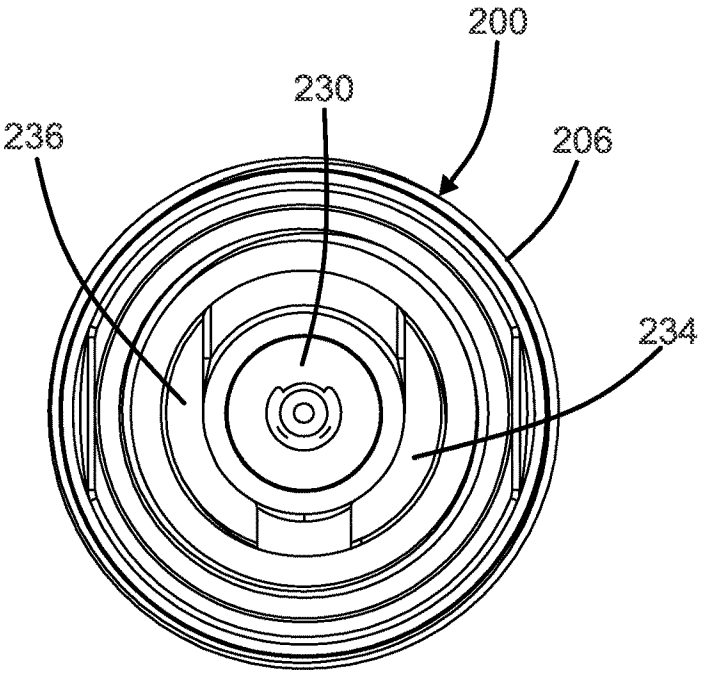
FIG. 12 is a front view of the diverter of FIG. 10.

FIGS. 12 and 13 are front and rear views, respectively, of the diverter 200. As shown in FIGS. 12 and 13, the housing 206 defines one or more passageways 234, 236 positioned around the compartment 208 to allow the water from the water supply to flow around the compartment 208 and exit the internal opening 232 of the front piece 222. The compartment 208 advantageously shields the spring 216 from the water that flows in the passageways 234, 236 so that mineral deposits do not build up around the spring 216 after prolonged use of the faucet assembly 10, and thereby improves the durability of the faucet assembly 10.

In addition to the foregoing, there are other ways to affect linear movement of the plunger, such as those described in U.S. Provisional Patent Application No. 63/193,503, filed May 26, 2021, of which is incorporated by reference in its entirety The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A faucet assembly comprising:

a spout configured to receive a water flow, the spout including:

a body that defines an interior cavity;

a central axis that extends along a length of the body between a proximal end and a distal end of the body;

a slot located between the proximal end and the distal end of the body; and an outlet located at the distal end of the body; and a diverter at least partially housed inside the interior cavity of the spout, the diverter including:

a housing having a front end defining an internal opening and an opposite rear end, wherein the internal opening of the housing is spaced from and in fluid communication with the outlet of the spout, the housing defining a compartment having an opening aligned with the slot on the body of the spout, and defining one or more passageways inside the interior cavity of the spout, the one or more passageways being positioned around the compartment to allow passage of the water flow through the housing towards the outlet of the spout;

an actuator that includes a shaft that extends through the slot of the spout and into the compartment defined by the housing of the diverter, and a plunger connected to the shaft, the plunger being configured to slide in a first direction parallel to the central axis from a resting position to a diverting position, and configured to slide in a second direction parallel to the central axis from the diverting position to the resting position, the first and second directions being opposite directions, and the plunger being configured to seal the internal opening of the housing so as to block the water flow towards the outlet of the spout and divert the water flow away from the spout when in the diverting position; and a spring housed inside the compartment, wherein the spring is configured to move the plunger in the second direction from the diverting position to the resting position when the water flow is turned off.

2. The faucet assembly of claim 1, wherein the plunger includes a plug at a distal end that is configured to block the passage of the water flow from the one or more passageways defined by the housing of the diverter to the outlet of the spout.

3. The faucet assembly of claim 1, wherein the housing of the diverter shields the spring from the water flow.

4. The faucet assembly of claim 1, wherein the shaft is threadably connected at a first end to the plunger, and the shaft is threadably connected at a second end to a handle, and the handle is configured to be gripped by a user to slide the plunger between the resting and diverting positions.

5. The faucet assembly of claim 4, wherein the handle is shaped and sized to cover both the slot on the body of the spout and the opening of the compartment in the diverter housing when the actuator is in both the resting and diverting positions.

6. The faucet assembly of claim 1, wherein the spring is positioned around the plunger and between the compartment and the shaft, and the spring compresses when plunger slides into the diverting position.

7. The faucet assembly of claim 6, wherein the spring is configured to remain in a compressed state due to a pressure exerted on the plunger from the water flow.

8. The faucet assembly of claim 7, wherein the spring is configured to expand from the compressed state when the water flow is turned off, causing the plunger to slide in the second direction from the diverting position to the resting position.

9. The faucet assembly of claim 1, wherein the compartment has a drainage hole to drain water that enters through the opening of the compartment.

10. A diverter for a spout, the diverter comprising:

a housing having a front end defining an internal opening and an opposite rear end, the housing defining a compartment with an opening and one or more passageways positioned around the compartment to allow passage of a water flow from the rear end towards the front end of the housing; and an actuator that includes a shaft that extends into the opening of the compartment, and a plunger connected to the shaft in a substantially orthogonal arrangement and housed inside the compartment, the actuator being slidable in a first direction from a resting position to a diverting position and in a second direction from the diverting position to the resting position, the first and second directions being opposite directions that are parallel to a central axis of the spout, and the plunger being configured to seal the internal opening of the housing so as to block the water flow out of the front end of the housing when the actuator is in the diverting position.

11. The diverter of claim 10, further comprising a spring housed inside the compartment, wherein the spring returns the actuator from the diverting position to the resting position when the water flow is turned off.

12. The diverter of claim 10, wherein the plunger is configured to slide in the first and second directions between the resting and diverting positions.

13. The diverter of claim 10, wherein the plunger includes a plug at a distal end that is configured to block the passage of the water flow from the one or more passageways.

14. The diverter of claim 10, wherein a spring is positioned around the plunger and between the compartment and the shaft, and the spring compresses from a relaxed state to a compressed state when the plunger slides into the diverting position.

15. The diverter of claim 14, wherein the spring is configured to remain in the compressed state due to a pressure from the water flow.

16. The diverter of claim 14, wherein the spring expands from the compressed state to the relaxed state when the water flow is turned off, causing the plunger to slide in the second direction from the diverting position to the resting position.

17. The diverter of claim 10, further comprising a handle connected to the shaft and configured to be gripped by a user to slide the plunger in the first and second directions between the resting position and the diverting position.

18. The diverter of claim 17, wherein the handle is shaped and sized to cover the opening of the compartment when the actuator is in the resting and diverting positions, and wherein the compartment shields the spring from the water flow.

19. The diverter of claim 10, wherein the compartment has a drainage hole to drain water that enters through the opening of the compartment.

* * * * *